US005813052A

United States Patent [19]

Taylor

[11] Patent Number: 5,813,052

[45] Date of Patent: Sep. 29, 1998

[54] ZONED SURGICAL GOWN

[75] Inventor: Jeffrey L. Taylor, Cincinnati, Ohio

[73] Assignee: Standard Textile Co., Inc., Cincinnati, Ohio

[21] Appl. No.: 146,498

[22] Filed: Nov. 1, 1993

[51] Int. Cl.[6] ..... A41D 13/00; A41D 13/04

[52] U.S. Cl. ..... 2/114; 2/243.1; 2/105; 2/69

[58] Field of Search ..... 2/46, 48, 49.1, 2/49.2, 49.3, 49.4, 49.5, 50, 51, 52, 69, 69.5, 104, 105, 106, 114, 115, 901

[56] References Cited

U.S. PATENT DOCUMENTS

| | | | |
|---|---|---|---|
| 3,868,728 | 3/1975 | Krzewinski | 2/114 |
| 4,504,977 | 3/1985 | King et al. | 2/114 X |
| 4,504,978 | 3/1985 | King et al. | 2/114 |
| 4,622,699 | 11/1986 | Spriggs | 2/114 |
| 4,736,467 | 4/1988 | Schwarze et al. | 2/114 |
| 4,991,232 | 2/1991 | Taylor | 2/114 |
| 5,271,100 | 12/1993 | Holt | 2/114 |

*Primary Examiner*—Jeanette E. Chapman
*Attorney, Agent, or Firm*—Frost & Jacobs LLP

[57] ABSTRACT

An improved surgical gown is provided which has, at its central operative field and the operative zones of the sleeves, a liquid repellent, moisture vapor transmitting material, an inner layer of a breathable material, and an intermediate layer of a liquid proof material interposed therebetween.

11 Claims, 4 Drawing Sheets

ZONED SURGICAL GOWN

TECHNICAL FIELD

The present invention relates generally to surgical gowns, and is particularly directed to surgical gowns having zones of enhanced protection against liquid penetration. The invention will be specifically disclosed in connection with a surgical gown in which, at certain critical areas, there is an outer layer of a liquid repellent, moisture vapor transmitting material, an inner layer of a breathable material, and an intermediate layer of a liquid proof material interposed therebetween.

BACKGROUND OF THE INVENTION

A primary purpose of a surgical gown is to prevent the spread of infection to and from the patient and surgeon during surgical procedures. In order to do so, it is necessary for the surgical gown to prevent bodily fluids and other liquids present during surgical procedures from flowing through the gown, thereby establishing a liquid path along which viruses, bacteria or contaminants may travel. Various materials and designs have been used in the manufacture of gowns, providing various levels of protection and comfort.

Gowns made of liquid proof material are known in the art. Such material is available in a wide range of "imperviousness", depending upon what standard is being referenced. While such completely impervious material provides a high degree of protection, a gown constructed of such material, particularly reusable gowns, are very heavy due to the weight of the material, expensive, and usually hot to wear due to the lack of the materials ability to transmit water vapor (breathe). In some such gowns, the yoke, shoulders and back panels may be made of a lighter weight, moisture vapor transmitting, breathable, liquid repellant material. Generally, the higher the breathability of the material, the lower its repellency, limiting its use to the lesser critical areas of the gown. Ultimately, despite such improvements, gowns in which the front panel and sleeves are made of a liquid proof material are limited to use in highly infectious or fluid intense procedures.

Surgical gowns constructed of material which is both breathable and liquid repellant are also known. However, there are varying levels of repellency, not all of which are suitable for surgical gowns. Liquid repellant material may be capable of repelling liquid sprayed on to or merely resting on the surface of the material. However, when the liquid is placed under even moderate pressure, such as that which occurs when the surgeons leans against objects, the liquid can be forced through the material, establishing a path for microorganisms.

It is known in the art to provide additional layers of protection in certain critical areas or zones of the surgical gown. Such critical zones are the areas which require the greatest repellency or imperviousness to liquid penetration. This includes an area of the front panel frequently referred to as the central operative region, and the lower portion of the sleeves generally from the elbow to the cuff.

However, such prior art designs do not necessarily provide sufficient protection in many procedures. Such prior art designs are primarily focused on constructions suitable only to disposable gowns. Reusable gowns, which are less expensive per use over the life of the gown, are receiving renewed attention.

SUMMARY OF THE INVENTION

Accordingly, it is a primary object of the present invention to provide a low cost gown having liquid proof protection in certain critical zones, which is light in weight, having improved breathability and moisture vapor transmissivity, while maintaining the desired liquid proof properties.

Still another object of the present invention is to provide a surgical gown which additionally, as a reusable surgical gown, may be subjected to a substantial number of washings/drying/sterilization cycles while maintaining its protective qualities.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims. To achieve the foregoing and other objects, and in accordance with the purposes of the present invention as described herein, an improved surgical gown is provided which has, at its central operative field and the operative zones of the sleeves, a liquid repellent, moisture vapor transmitting material, an inner layer of a breathable material, and an intermediate layer of a liquid proof material interposed therebetween.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects, all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
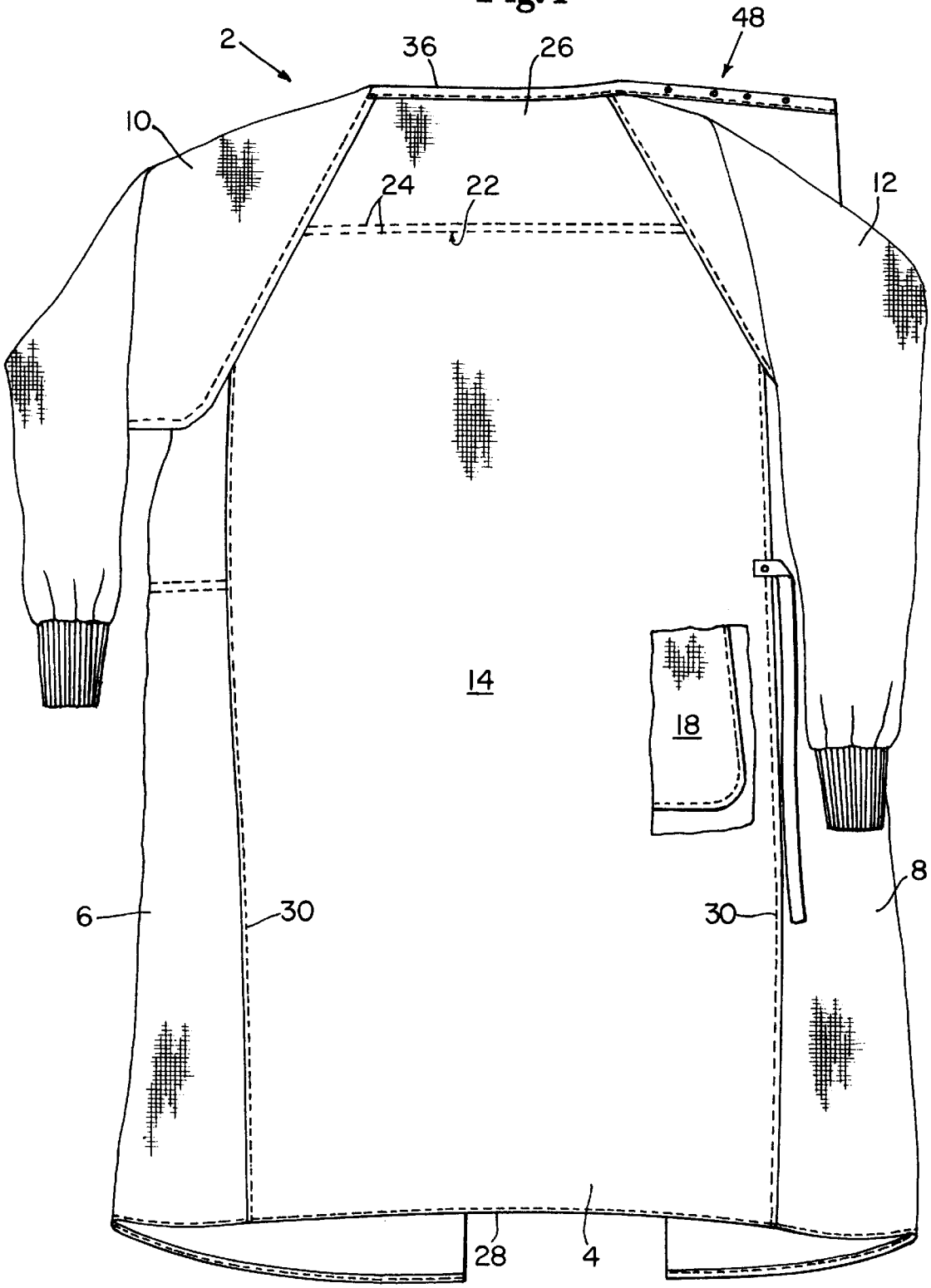
FIG. 1 is a front view of a surgical gown constructed according to the present invention, with a portion of the outer layer of the front panel cut away to reveal the intermediate layer.
Figure 2:
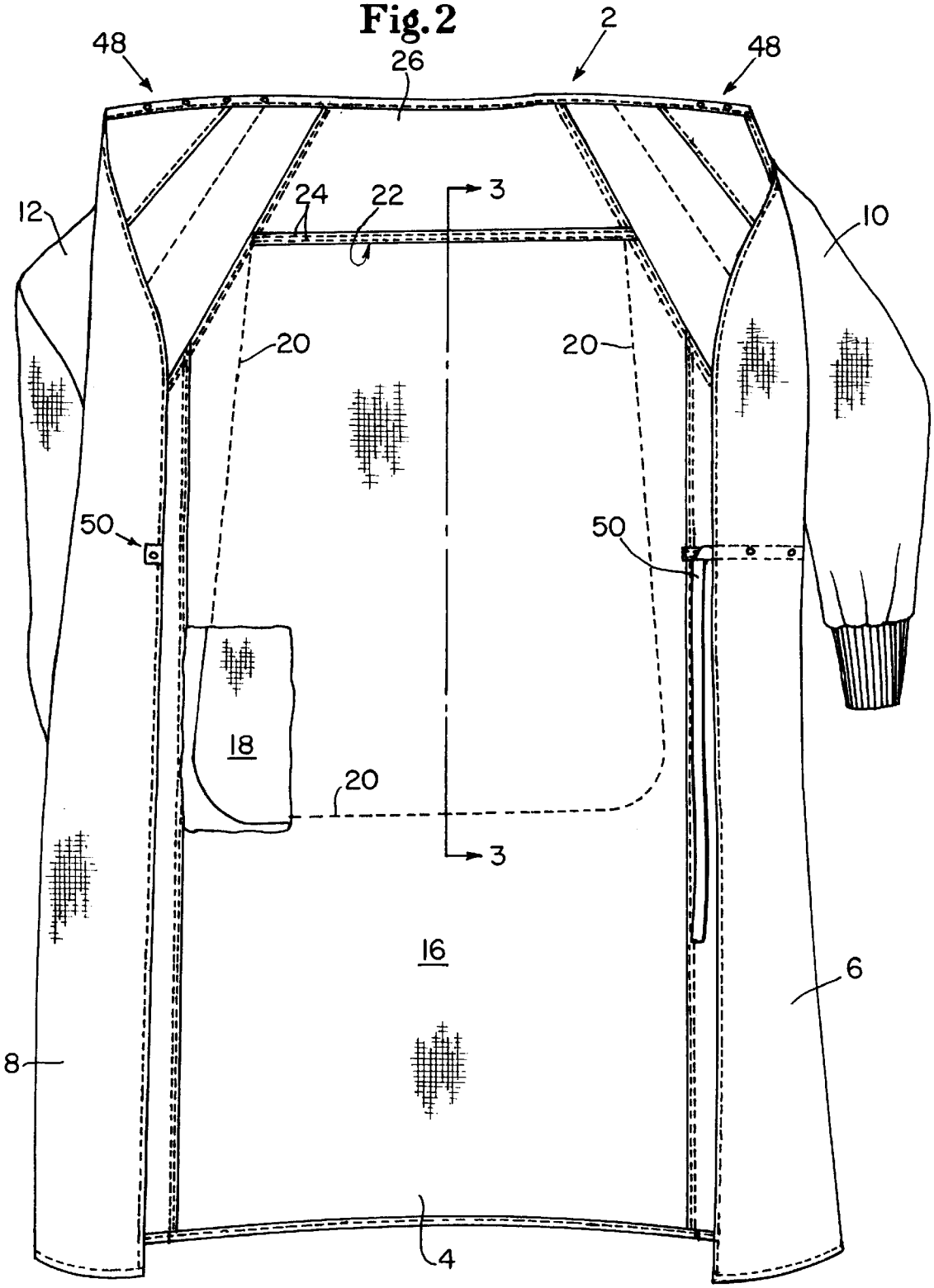
FIG. 2 is a rear view showing the inner surface of the front panel, with a portion of the inner layer cut away to reveal the intermediate layer.

Referring now to the drawings, FIG. 1 illustrates a front view and FIG. 2 illustrates a rear view of surgical gown 2. Gown 2 includes front panel 4 having back panels 6 and 8 extending integrally on either side thereof. Additionally, sleeves 10 and 12 are also connected integrally with front panel 4 and back panels 6 and 8.

Front panel 4 extends from the top to the bottom of the front of gown 2, and comprises outer layer 14, inner layer 16, and intermediate layer 18 which is generally coextensive with the region referred to as the central operative field of front panel 4. As used herein, "central operative field" refers to that part of a surgical gown which is most likely to be contacted with blood, various body fluids, or treating liquids such as water or saline solutions, during the course of a particular surgical procedure. It will be understood that the size of the central operative field will vary according to the particular procedure being performed. In some instances, the central operative field would include only a part of the front panel, such as the front chest from the nipples to the crotch. Intermediate layer 18 may, of course, extend beyond the central operative field, generally at the sacrifice of comfort and weight.

As shown in FIG. 2, the side and lower peripheral edges of intermediate layer 18 are secured to inner layer 16 by stitching 20. In the preferred embodiment, outer layer 14 is a continuous sheet of material extending from neck 36 to lower edge 28 of gown 2. As can be seen in FIG. 1, stitching 20 does not extend through outer layer 14 such that there are no stitch holes within the central operative field through which liquid can pass. Above upper edge 22 of the central operative field, intermediate layer 18 is sewn to outer layer 14 and inner layer 16 by stitching 24. Although stitching 24 creates holes through all three layers, its location above upper edge 22 of the central operative field is in a non-critical area of the gown. In the preferred embodiment of the present invention, there are no stitch holes in front panel 4 located below upper edge 22 of the central operative field, with the exception the stitching along the edges which connects front panel 4 to rear panel 6 and 8 and sleeves 10 and 12.

In the preferred embodiment, inner layer 16 does not extend above stitches 24 such that yoke region 26 comprises only outer layer 14, which improves the moisture vapor transmission and breathability. It is noted, however, that in accordance with the present invention, inner layer 16 could be coextensive with outer layer 14 such that the stitch holes through outer layer 14 are eliminated by sewing intermediate layer 18 only to inner layer 16 along neck 36. Inner layer 16 extends downwardly from upper edge 22 to lower edge 28 of front panel 4, being secured along its edges by stitching 30 to outer layer 14, back panels 6 and 8, and sleeves 10 and 12. Alternatively, inner layer 16 may terminate in a hem at some location above lower edge 28, the important consideration being that outer layer 14 be devoid of stitch holes in and below the central operative field so that pathways for microorganisms are not created.

Figure 3:
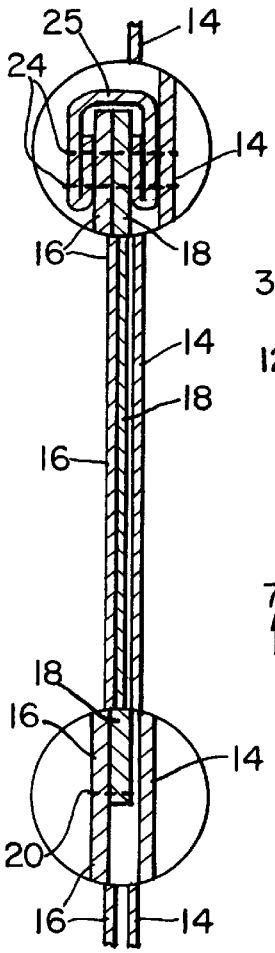
FIG. 3 is a cross-sectional view taken along line 3—3 of FIG. 2.

Referring now to FIG. 3, wherein the thickness of the various layers has been exaggerated for clarity, there is shown a cross-section of front panel 4 taken through the central operative field. Intermediate layer 18 is shown interposed between outer layer 14 and inner layer 16. In the upper magnified circle of FIG. 3, stitching 24 is shown securing all three layers together, as described above. Binding 25 encloses the upper edges of inner layer 16 and intermediate layer 18 to prevent fraying. In the lower magnified circle of FIG. 3, stitching 20 is shown securing intermediate layer 18 only to inner layer 16 about its side and bottom peripheral edges. Outer layer 14 is illustrated spaced apart from intermediate layer 18, being free to move relative thereto. Additionally, binding may also be used to enclose the side and bottom peripheral edges of intermediate layer 18 if necessary to prevent fraying.

Figure 4:
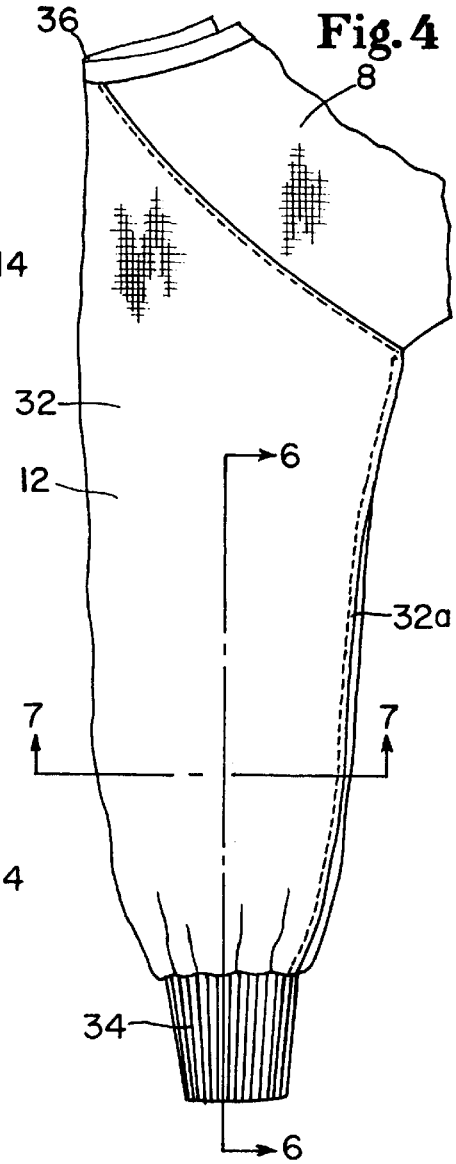
FIG. 4 is a fragmentary rear plan view of the left sleeve of the gown.
Figure 5:
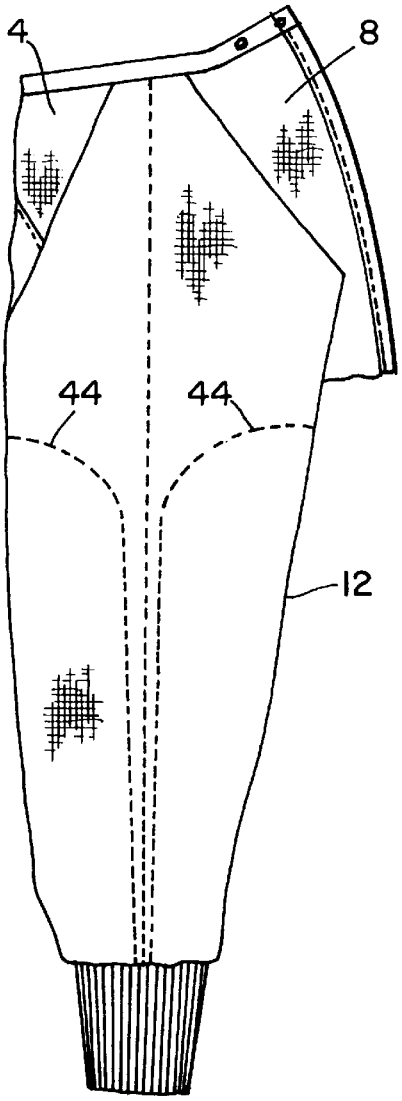
FIG. 5 is a fragmentary top view of the left sleeve of the gown with the stitching of the inner and intermediate layers illustrated in broken lines.

The preferred embodiment of the construction of the sleeves, each of which is essentially a mirror image of the other, is shown generally in FIGS. 4–9. Since each sleeve has similar construction, only left sleeve 2 will be discussed, it being understood that right sleeve 10 is similarly constructed. As used herein, left and right refer to the wearer's left and right. FIG. 4 shows a rear plan view of left sleeve 12 which includes outer layer 32 which extends from knitted cuff 34 to neck 36, being integrally sewn to left back panel 8 and front panel 4 (not seen in FIG. 4). Outer layer 32 is preferably a single continuous piece of material stitched only along seam 32*a* and where it joins back panel 8, front panel 4 and neck 36.

Figure 6:
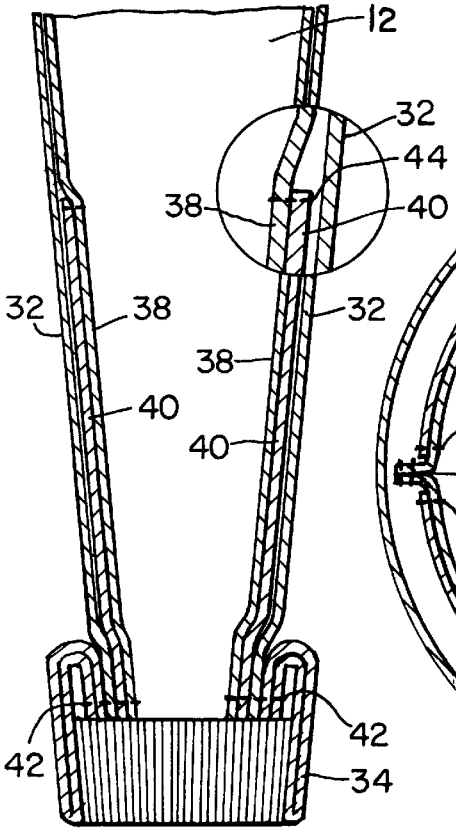
FIG. 6 is a cross-sectional view taken along line 6—6 of FIG. 4.
Figure 7:
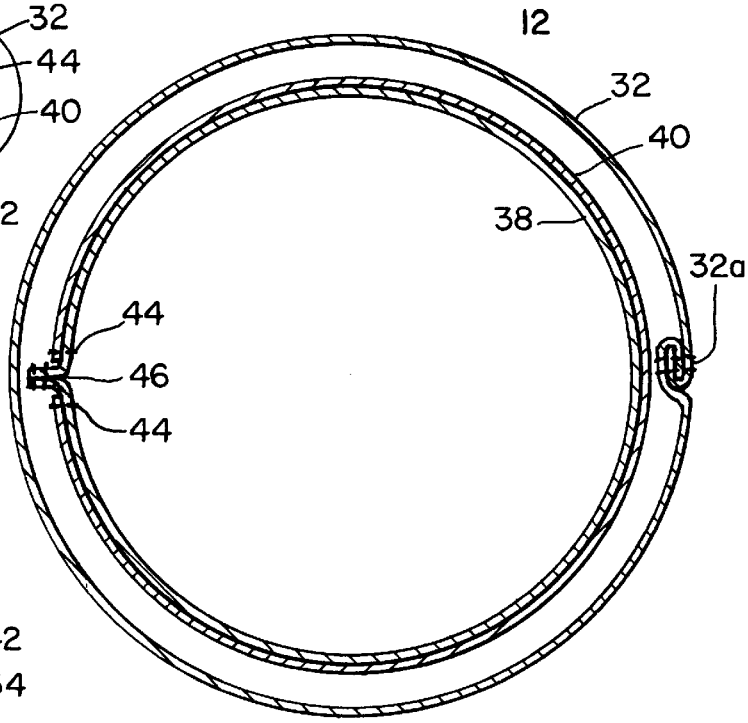
FIG. 7 is a cross-sectional view of the left sleeve taken along line 7—7 of FIG. 4.
Figure 8:
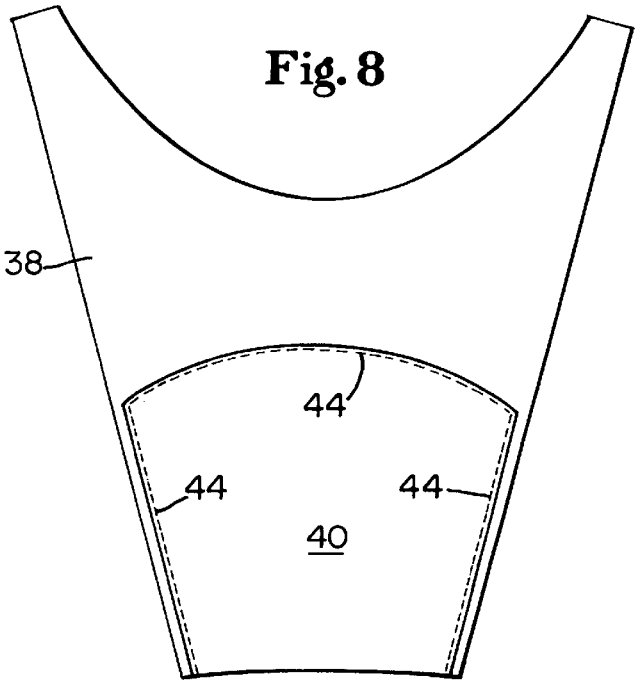
FIG. 8 is a pattern of the inner layer of the left sleeve, showing the intermediate layer secured thereto.

Referring also to FIG. 6 and FIG. 7, left sleeve 12 comprises outer layer 32, inner layer 38 and intermediate layer 40. At the distal end of left sleeve 12, cuff 34 and layers 32, 38 and 40, are secured together by stitching 42, intermediate layer 40 is interposed between inner layer 38 and outer layer 32, located within the sleeve operative zone. As used herein, "sleeve operative zone" refers to that part of the sleeve which is most likely to be contacted with blood, various body fluids, or treating liquids such as water or saline solutions, during the course of a particular surgical procedure. It will be understood that the size of the sleeve operative zone may vary according to the particular procedure being performed. In most instances, the sleeve operative field would include the lower sleeves, approximately from the cuff up to, on the bottom side of the sleeve, midway between the shoulder and the elbow. As can be seen in the enlargement circle of FIG. 6, and by reference to FIG. 5, intermediate layer 40 is secured only to inner layer 38 about its peripheral edges by stitching 44. The general shape of intermediate layer 40 can be seen in FIG. 8, which illustrates an plan view of inner layer 38 of left sleeve 12 as a pattern before it is sewn into its tubular shape.

FIG. 7 illustrates the circumferential offset between seam 32*a* and seam 46, a construction which is described in U.S. Pat. No. 4,991,232, which is incorporated herein by reference. This construction increases the barrier to liquids approaching the wearer.

Figure 9:
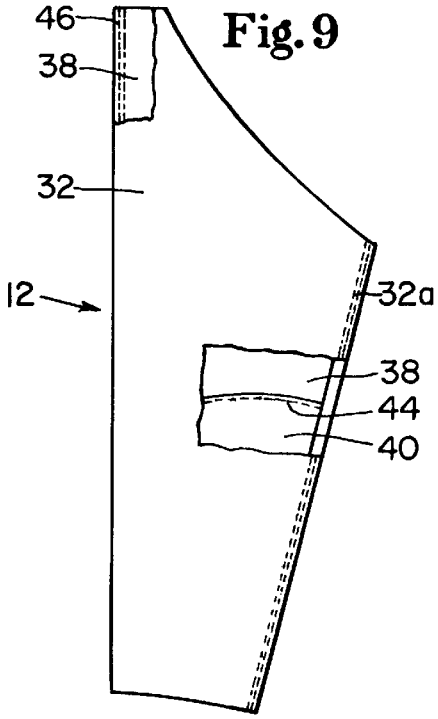
FIG. 9 is the left sleeve by itself with cutaways revealing the intermediate and inner layers.

FIG. 9 illustrates left sleeve 12 before it is attached to gown 2 and before cuff 34 has been attached. In the upper cutaway, near the shoulder, outer layer 32 is cut away, revealing seam 46 and inner layer 38. In the lower cutaway, outer layer 32 is cutaway, revealing intermediate layer 40 secured to inner layer 40 by stitching 44.

Returning to FIGS. 1 and 2, gown 2 may be secured in place by any neck closure means, generally indicated at 48 and by any waist closure means, generally indicated at 50. In the preferred embodiment, neck closure means 48 and waist closure means 50 are of the tear away design as described in the co-pending application entitled "Surgical Gowns With Tear Away Fastener Release" in the names of the present inventor, Jeffrey L. Taylor, and Veronica Ann Mills, filed on Oct. 28, 1993, and assigned to the assignee of this application, the disclosure of which is incorporated herein by reference.

In the preferred embodiment, outer layer 14 of front panel 4, and outer layers 32 of both sleeves 10 and 12, comprise a liquid repellant, moisture vapor transmitting woven material. This material preferably has a moisture vapor transmission rate ("MVTR") of at least about 600 gms/24-hr., as measured in accordance with ASTM E-96, Method B. This allows moisture vapor and the heat carried therein to pass through the material, reducing heat build up and discomfort caused thereby. The material should have a hydrostatic resistance of at least about 30 centimeters as measured by the Water Resistance Hydrostatic Pressure Test (Suter)-AATCC 127-1989. In the preferred embodiment, a material known as ComPel® O, available from Standard Textile Company, Inc. of Cincinnati, Ohio, was used for these layers. Such a material is disclosed in U.S. Pat. No. 4,882,667, 4,919,998 and 5,024,851, the disclosures of which are incorporated herein by reference. This material, in single ply form has a MVTR of at least about 1100 gms/24-hr., and at least about a 50 centimeter hydrostatic resistance. Additional plies could be used which would increase the hydrostatic resistance and weight, while reducing the MVTR.

In the preferred embodiment, intermediate layer 18 of the central operative field and front panel 4, and intermediate layer 40 of the sleeves is preferably a liquid proof material. ASTM Emergency Test Methods ES-21 and ES-22 establish test methods for materials to determine resistance to penetration of blood, other body fluids and blood borne pathogens. These test methods recommend a minimum pressurization of 2 psig, which corresponds to a Water Resistance Hydrostatic Pressure Test-AATCC 127-1989 (Suter) rating of 140 centimeters. These recommendations include a minimum Water Resistance Hydrostatic Pressure Test-AATCC 127-1989 (Suter) rating of 140 centimeters. At a minimum, layers 18 and 40 should meet these standards. In general, a very high resistance to hydrostatic pressure is desired. Preferably, the material should have a rating of at least about 250 centimeters under the Water Resistance Hydrostatic Pressure Test-AATCC 127-1989 (Suter). In the preferred embodiment, a material known as ComPel® XTR available from Standard Textile was used, which has a Water Resistance Hydrostatic Pressure Test-AATCC 127-1989 (Suter) rating of 1750 centimeters. Such a material is disclosed in U.S. Pat. Nos. 5,183,702 and 5,236,532, the disclosures of which are incorporated herein by reference. This material, in combination with the lack of puncture holes therethrough, provides a liquid proof barrier in the central operative field and the sleeve operative zones.

In the preferred embodiment, inner layer 16 of front panel 4, back panels 6 and 8, and inner layer 38 of sleeves 10 and 12 comprises a material which is moderately repellant and highly breathable, although a non-repellant material may be used for inner layers 16 and 38. In the preferred embodiment, this material has a Water Resistance Hydrostatic Pressure Test-AATCC 127-1989 (Suter) rating of at least about 15 centimeters. The air permeability (porosity) of this material should be relatively high to provide maximum comfort, preferably having an air permeability of at least about 20 CFM/ft$^2$ as measured in accordance with ASTM D737-80. In the preferred embodiment, a material known as Comfort Panel, available from Standard Textile, was used. Such material has an air permeability of at least about 29 CFM/ft$^2$ s measured in accordance with ASTM D737-80.

In the preferred embodiment, woven material is used, primarily because of its suitability for reusable gowns. The particular materials used in the preferred embodiment are capable of retaining the necessary characteristics even after repeated institutional washing/drying/sterilization cycles. While woven is preferred, non-woven and knitted material having the desired characteristics may be used. If the gown is to be reusable, the material must retain its characteristics throughout the life of the gown. If the gown is to be disposable, retention of these characteristics is not a factor.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A surgical gown having a front panel and sleeves integrally connected to said front panel, said front panel having a central operative field comprising:

(i) an outer layer of a liquid repellent, moisture vapor transmitting material;

(ii) an inner layer of a breathable material; and (iii) an intermediate layer of a liquid proof material interposed between said outer and inner layers.

2. A surgical gown according to claim 1, wherein said intermediate layer is approximately the size of said central operative field, said intermediate layer being secured to said inner layer.

3. A surgical gown according to claim 2, wherein said intermediate layer is sewn to said inner layer.

4. A surgical gown according to claim 1, wherein each of said sleeves includes a sleeve operative zone, said sleeve operative zone comprising an outer layer of a liquid repellent, moisture vapor transmitting material, an inner layer of a breathable material, and an intermediate layer of a liquid proof material interposed between said outer and inner layers.

5. A surgical gown according to claim 4, wherein said intermediate layers of said sleeve operative zone are sewn to the respective inner layers.

6. A surgical gown according to claim 1, wherein said surgical gown includes back panels integrally connected to said front panel, said back panels being made of a moderately repellant and breathable material.

7. A surgical gown comprising:

(a) a front panel having a central operative field, said central operative field having an upper edge;

(b) sleeves connected integrally to said front panel;

(c) said front panel comprising:

(i) an outer layer of a liquid repellent, moisture vapor transmitting material;

(ii) an inner layer of a breathable material extending downwardly generally from proximal said upper edge of said central operative field; and (iii) an intermediate layer of a liquid proof material interposed between said outer and inner layers, said intermediate layer being approximately the size of said central operative field and aligned therewith, said intermediate layer being secured to said inner layer.

8. A surgical gown according to claim 7, wherein said outer layer is a continuous sheet which is coextensive with said front panel.

9. A surgical gown according to claim 7, wherein each of said sleeves includes a sleeve operative zone, said sleeve operative zone comprising an outer layer of a liquid repellent, moisture vapor transmitting material, an inner layer of a breathable material, and an intermediate layer of a liquid proof material interposed between said outer and inner layers.

10. A surgical gown according to claim 9, wherein at least one of said intermediate layer of said central operative field and said intermediate layers of said sleeve operative zones are secured to the respective inner layer.

11. A surgical gown according to claim 10, wherein said secured intermediate layer is secured by sewing.

* * * * *